US012345474B2

(12) United States Patent
Kulkarni et al.

(10) Patent No.: US 12,345,474 B2
(45) Date of Patent: Jul. 1, 2025

(54) VARIABLE CONDUCTANCE HEAT PIPES FOR IMPROVED RELIABILITY

(71) Applicant: Intel Corporation, Santa Clara, CA (US)

(72) Inventors: Devdatta Prakash Kulkarni, Portland, OR (US); Bijoyraj Sahu, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 903 days.

(21) Appl. No.: 17/130,906

(22) Filed: Dec. 22, 2020

(65) Prior Publication Data

US 2021/0108860 A1 Apr. 15, 2021

(51) Int. Cl.
*F28D 15/06* (2006.01)
*F28D 15/02* (2006.01)

(52) U.S. Cl.
CPC ..... *F28D 15/06* (2013.01); *F28D 15/0233* (2013.01); *F28D 15/0275* (2013.01)

(58) Field of Classification Search
CPC ... F28D 15/06; F28D 15/0233; F28D 15/0275
See application file for complete search history.

(56) References Cited

U.S. PATENT DOCUMENTS

2007/0034355 A1* 2/2007 Kuo ..... F28D 15/02 257/E23.098
2009/0294117 A1* 12/2009 Hodes ..... H01L 23/427 165/104.34
2020/0008321 A1* 1/2020 Marcoccia ..... F28D 15/0275

OTHER PUBLICATIONS

Advanced Cooling Technologies, Inc., "Axial Groove Variable Conductance Heat Pipes," (Dec. 2012) available online at least as early as Dec. 2012 at URL: https://www.1-act.com/wp-content/uploads/2012/12/vchp.pdf. (2 pages).

* cited by examiner

*Primary Examiner* — Schyler S Sanks
(74) *Attorney, Agent, or Firm* — Alliance IP, LLC

(57) ABSTRACT

A variable conductance heat pipe (VCHP) is utilized as a "passive heat switch" to regulate a characteristic temperature of an integrated circuit component. The VCHP is located between an integrated circuit component and a cold plate and comprises a working fluid and a non-condensable gas in a chamber. When the component is not operational, the VCHP blocks the flow of heat from the component to the cold plate. As component power consumption increases, the working fluid pressure increases and compresses the non-condensable gas toward the cooler region of the cold plate to eventually create a low thermal resistance path between the component and the cold plate. By introducing negative feedback into the thermal management solution, the VCHP keeps the characteristic temperature within a narrow range. This can alleviate stress on package components (e.g., solder joints) due to excessive thermal cycling, which can extend the lifetime of the component.

15 Claims, 6 Drawing Sheets

VARIABLE CONDUCTANCE HEAT PIPES FOR IMPROVED RELIABILITY

BACKGROUND

Integrated circuit components experience large temperature differences as they switch between idle and active states. Subjecting integrated circuit components to frequent large thermal swings over a long period can stress its constituent components. If enough stress is induced, a constituent component can degrade or fail, which can result in premature failure of the component.

DETAILED DESCRIPTION

Figure 1A:
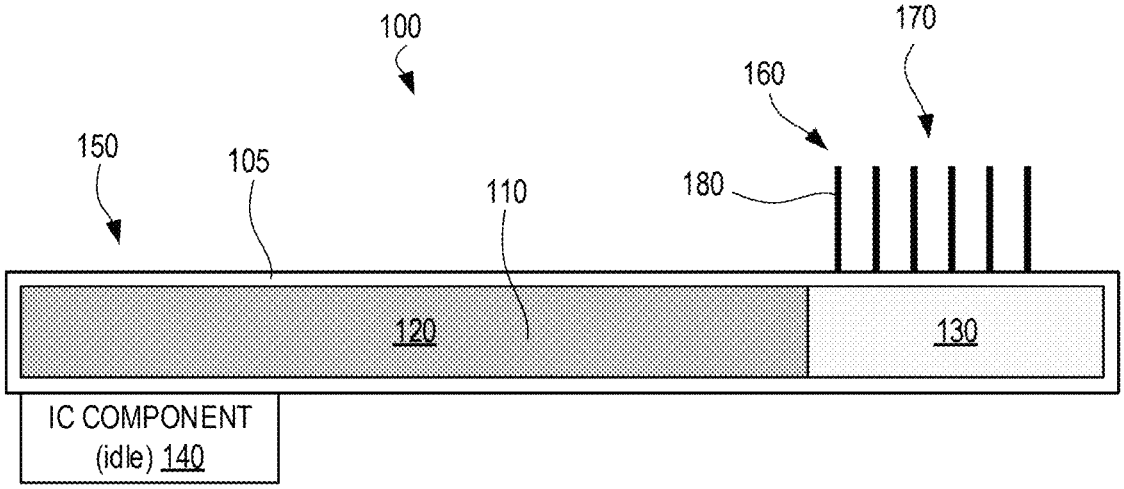
FIGS. 1A-1B illustrate cross-sectional views of an example variable conductance heat pipe.

Variable conductance heat pipes (VCHPs) are disclosed herein that operate as a "passive heat switch" to stabilize thermal swings in integrated circuit components and thereby improve their reliability. In some existing integrated circuit packages comprising multiple processing units (e.g., multi-chip packages (MCPs), multi-chip modules (MCMs)), the multiple processing units can be of different types. These heterogeneous integrated circuit packages can comprise general-purpose processing units, specialized processing units tailored to run different types of workloads (e.g. GPUs, accelerators), input/output (I/O) controllers, and additional processor types or other integrated circuits. In some embodiments, a heterogeneous integrated circuit can comprise one or more instances of a first integrated circuit and one or more instances of a second integrated circuit that is different than the first integrated circuit. Due to the difficulty in reliably manufacturing large monolithic integrated circuits in advanced semiconductor manufacturing technology nodes at volume, multiple smaller interconnected integrated circuits can be used to implement the functionality of a single larger monolithic die. Using this approach, a manufacturing defect can render one of the smaller integrated circuit dies inoperable instead of the larger monolithic die and overall manufacturing yield can be improved. These smaller dies can range in size and functionality to allow for various degrees of modularity. For example, the smaller dies can comprise processor cores, GPUs, I/O controllers, or their constituent components (e.g., cache memory, an individual PCIe link). In some embodiments, these smaller dies can be referred to as "chiplets".

Along with the increasing number of processor units integrated into a single integrated circuit package in successive manufacturing technology generations, there is an increase in the amount of power that these processor units consume. For some existing heterogeneous integrated circuit packages, direct liquid cooling is used to cool the package. Direct liquid cooling cools an integrated circuit package by using heat generated by integrated circuits within the package to heat a cooling liquid flowing through a cold plate attached to the package. Because different processor units in a heterogeneous integrated circuit package can be tailored to perform different workloads, different processor units can experience different utilization rates. For example, a general-purpose processing unit may operate more continuously under full power conditions than a processing unit tailored to execute a specific workload type. In such a situation, the general-purpose processing unit may be subjected to a lower degree of power and thermal cycling than the tailored processing unit.

High degrees of thermal cycling can stress components in an integrated circuit product, which can create reliability issues. In some cases, these components can degrade or fail, which can lead to premature product failure. When a processor unit is operating in an idle state the temperature of the processor unit and components located therein and attached to the package can be close to the temperature of a cooling liquid entering an attached cold plate. The temperature of a cooling liquid entering a cold plate can be up to 17° C. as per American Society of Heating, Refrigerating and Air-Conditioning Engineers (ASHRAE) class W1 water class and up to 27° C. for ASHRAE class W2 water class. When a processor unit is operating at its thermal design point (or thermal design power, TDP) and generating a maximum amount of steady-state heat that its associated thermal management solution can handle, the temperature of the processor unit and package components can increase. In some embodiments, the temperature of these components can be expected to increase up to 95° C. to 100° C. under TDP conditions, which can be an almost 50° C. to 60° C. temperature difference from idle power state conditions.

Some users have workloads that cycle processing units between TDP and idle power states at least a few tens of cycles/day. Some integrated circuit components are not rated for this level of thermal cycling and, as a result, can fail prematurely. For example, solder joints that provide an electrical and physical connection between an integrated circuit package and a printed circuit board can crack due to excessive thermal cycling. This can result in the degradation of signals sent across the solder joint, or worse, create an "open" between the package and the printed circuit board, either of which can result in device or system failure. The solder joints can be comprised of or formed from solder balls used in packages comprising ball grid arrays. Components in other types of attach technologies used to attached integrated circuit packages to printed circuit boards have similar reliability susceptibilities, such as the pads in land grid arrays (LGAs), the pins in pin grid arrays (PGAs), and the bumps in direct-attach mounting techniques where an unpackaged integrated circuit die is directly attached to the printed circuit board. Components internal to an integrated circuit package, such as micro-bumps connecting stacked die (e.g., stacked high bandwidth memory (HBM) dies), inter-layer dielectrics (ILDs) located between the metal routing layers in an integrated circuit, wire bonds connecting internal die to the package substrate, and other integrated components (e.g., capacitors) are also at risk for reduced lifetime due to a high amount of thermal cycling. The package material (e.g., epoxy plastic) of an integrated circuit package can be susceptible to reliability issues (e.g., corner fillet cracking) due to high amounts of thermal cycling as well.

In another example of thermal cycling-induced component degradation, the thermal interface material that can be used to attach an integrated circuit package to a cold plate can be "pumped out" of the package-cold plate interface. For example, in some integrated circuit packages, the package surface located adjacent to the cold plate comprises an integrated heat spreader, which, in addition to providing mechanical stability, reduces the thermal resistance between the package and the cold plate. An integrated heat spreader can be flat or have some curvature (e.g., a concave curvature from an external perspective of the package) at room temperature. As the package heats during operation, the temperature of the integrated heat spreader increases. Due to the loading of the cold plate and, in some embodiments, the physical constraints of a socket within which the package is located, the integrated heat spreader can become flatter (if it is curved at room temperature) or take on more curvature (if flat at room temperature). Over the course of many temperature cycles due to, for example, varying workloads executed by processing units in the package, the thermal interface material between the integrated heat spreader and the cold plate can begin to pump out of the integrated heat spreader-cold plate interface. This pumping out of the thermal interface material can result in thermal degradation of processing units in the package over time. By being able to maintain a more constant temperature at the integrated heat spreader-cold plate interface, thermal interface material pump-out can be reduced and the processing units may experience allowable amounts of thermal degradation over the expected lifetime of the part.

In some instances, products rated for a five-year lifetime may fail much sooner if subjected to the high levels of power cycling possible in heterogeneous integrated circuit components. The susceptibility of packaged integrated circuit components to excessive thermal cycling can present not only a reliability issue but a security one. For example, a malevolent actor aware of such susceptibility could purposefully cause an integrated circuit product to be continuously subjected to workloads that create a high degree of thermal cycling, and potentially cause the product to fail prematurely.

One proposal to reduce the magnitude of thermal swings in integrated circuit packages is to increase the idle power level. For example, consider an integrated circuit product that has TDP and idle power consumption levels of ~400 W and 30 W, respectively, with solder joints attaching the package to a printed circuit board experiencing temperatures of 60° C. and 30° C. corresponding to TDP and idle conditions, respectively. If subjected to temperature changes of such magnitude frequently enough and over a long enough period, the product is likely to fail before its rated lifetime due to solder joint failure. If the temperature of the solder ball is not to drop below ~45° C. to prevent premature product failure due to solder joint thermal fatigue, this may force an increase in the idle power of the processor to 200 W to keep the solder joints at that temperature, in which case the idle state power consumption increases by 170 W.

Once idle state power consumption is increased, operational energy costs also increase. However, this increased energy cost may be offset by the savings associated with not having to replace integrated circuit products prematurely and avoiding reputational harm to the integrated circuit product vendor. Other possible solutions to keep an integrated circuit package at a higher temperature while operating in an idle state include adding an embedded cooler or heater into the package, the use of two-phase liquid cooling, or dynamically controlling the flow rate of cooling liquid through an attached cold plate. However, these solutions suffer from various disadvantages. Adding coolers or heaters into a package or die can introduce new reliability issues and having to power such parts requires increased energy consumption and having to route power to these new parts. Introducing two-phase cooling would require upgrades to a data center's infrastructure, and dynamic control of cooling liquid flow rate could require the introduction of solenoids that may not be able to respond fast enough to shifting workload demands and may also require the development of software algorithms to control the solenoids.

The variable conductance heat pipe (VCHP) disclosed herein is a passive, self-regulating thermal management solution that can maintain integrated circuit package temperature within a reduced temperature range to reduce the chances of premature part failure due to power cycling. In some embodiments, the use of a VCHP in a thermal management solution can maintain package temperature to within a range of a few degrees.

In the following description, specific details are set forth, but embodiments of the technologies described herein may be practiced without these specific details. Well-known circuits, structures, and techniques have not been shown in detail to avoid obscuring an understanding of this description. "An embodiment," "various embodiments," "some embodiments," and the like may include features, structures, or characteristics, but not every embodiment necessarily includes the particular features, structures, or characteristics.

Some embodiments may have some, all, or none of the features described for other embodiments. "First," "second," "third," and the like describe a common object and indicate different instances of like objects being referred to. Such adjectives do not imply objects so described must be in a given sequence, either temporally or spatially, in ranking, or any other manner. "The term "coupled", "connected", and "associated" may indicate elements electrically, electromagnetically, thermally, and/or physically (e.g., mechanically or chemically) co-operate or interact with each other, and do not exclude the presence of intermediate elements between the coupled, connected, or associated items absent specific contrary language. Terms modified by the word "substantially" include arrangements, orientations, spacings, or positions that vary slightly from the meaning of the unmodified term. For example, VCHP surfaces described as being substantially parallel to each other may be off of being parallel with each other by a few degrees.

The description may use the phrases "in an embodiment," "in embodiments," "in some embodiments," and/or "in various embodiments," each of which may refer to one or more of the same or different embodiments. Furthermore, the terms "comprising," "including," "having," and the like, as used with respect to embodiments of the present disclosure, are synonymous.

Reference is now made to the drawings, wherein similar or same numbers may be used to designate same or similar parts in different figures. The use of similar or same numbers in different figures does not mean all figures including similar or same numbers constitute a single or same embodiment. In the following description, for purposes of explanation, numerous specific details are set forth in order to provide a thorough understanding thereof. It may be evident, however, that the novel embodiments can be practiced without these specific details. In other instances, well-known structures and devices are shown in block diagram form to facilitate a description thereof. The intention is to cover all modifications, equivalents, and alternatives within the scope of the claims.

Figure 1B:
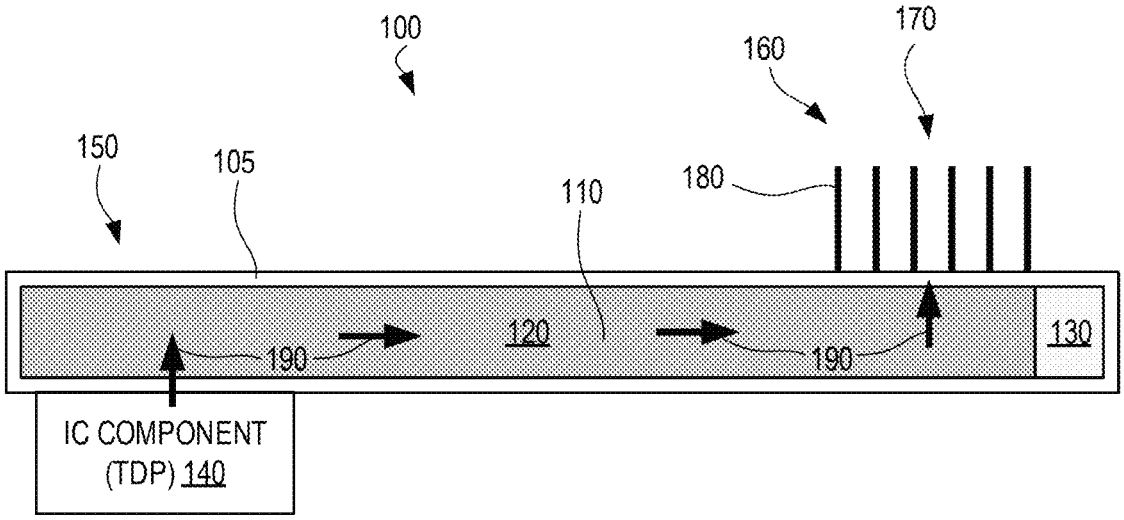

FIGS. 1A-1B illustrate cross-sectional views of an example variable conductance heat pipe operating in idle and TDP power states, respectively. The variable conductance heat pipe (VCHP) 100 comprises a thermally conductive casing 105 that encloses a chamber 110. The chamber contains a working fluid 120 and a non-condensable gas 130. The VCHP is attached to an integrated circuit component 140, at a first end (or "hot end") 150 of the VCHP 100 and to a condenser 160 at a second end (the "cold end") 170. When the integrated circuit component 140 is operating, the non-condensable gas 130 is driven toward the cold end 170 of the VCHP 100 by the working fluid vapor. The VCHP 100 works by varying the amount of the area of the condenser 160 available to the working fluid 120. FIGS. 1A and 1B illustrate VCHP conditions when the component 140 is operating in idle and TDP states, respectively. When the component 140 is operating in an idle state, the non-condensable gas 130 blocks the working fluid 120 from reaching a portion of the condenser. As the non-condensable gas 130 has a low thermal conductivity, heat flow from the component 140 to the condenser 160 is restricted.

With reference to FIG. 1B, under TDP conditions, the temperature of the component 140 has increased and the non-condensable gas 130 has been compressed by the expanded working fluid 120. As a result, the condenser 160 is exposed to the working fluid 120. This increases the thermal conductivity of the VCHP 100 along a path 190 from the component 140 to the condenser 160. The flow of heat generated by the component 140 along this path causes the component 140 to cool. As the component 140 cools, the vapor pressure of the working fluid 120 drops and the non-condensable gas 130 expands. This reduces the amount of the condenser 160 available to the working fluid 120 and decreases the thermal conductivity of the VCHP 100 along the path. Thus, the variable thermal conductance of the VCHP introduces negative feedback in the thermal system represented in FIGS. 1A & 1B, which works to regulate the temperature of the component 140. The condenser 160 is a heat sink comprising a plurality of fins 180 but in other embodiments, the condenser 160 can comprise any thermally conductive structure capable of transporting heat from the cold end 170 of the VCHP 100 to the surrounding environment. In some embodiments, the condenser 160 can be a cold plate.

As used herein, the term "integrated circuit component" refers to a packaged or unpacked integrated circuit product. A packaged integrated circuit component contains one or more integrated circuits. In one example, a packaged integrated circuit component contains a heterogeneous set of processor units and a solder ball grid array on an exterior surface of the package. In one example of an unpackaged integrated circuit component, a single monolithic integrated circuit die comprises solder bumps attached to contacts on the die. The solder bumps allow the die to be directly attached to a printed circuit board. Constituent components of an integrated circuit component include integrated circuit dies, bumps connecting stacked dies, HBM memories, wire bonds or solder bumps connecting a die to a package substrate, or other electrical components (e.g., capacitors), and other components.

Figure 2A:
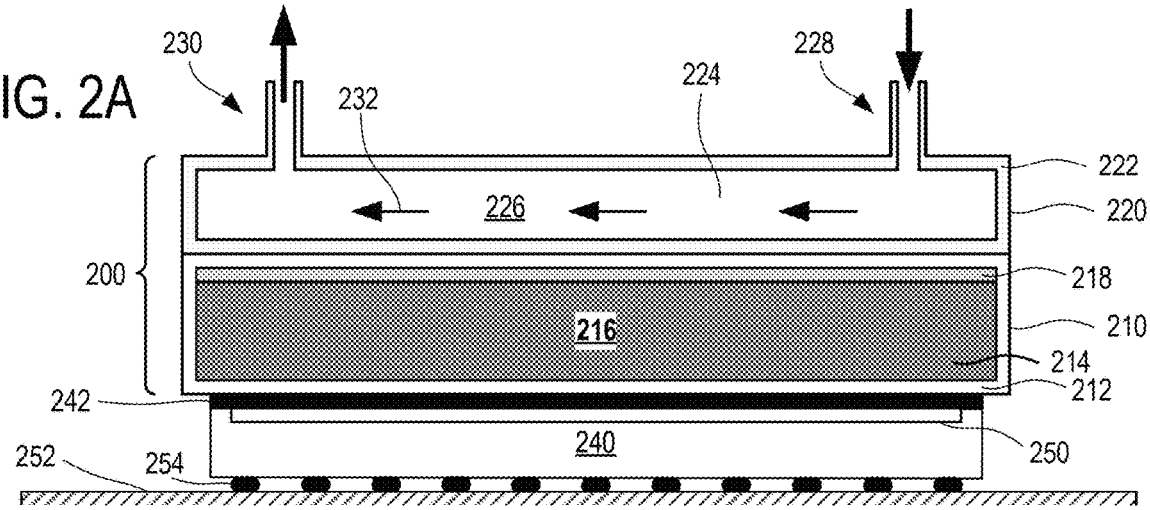
FIGS. 2A-2C illustrate cross-sectional views of an example VCHP-cold plate stack attached to an integrated circuit component.
Figure 2B:
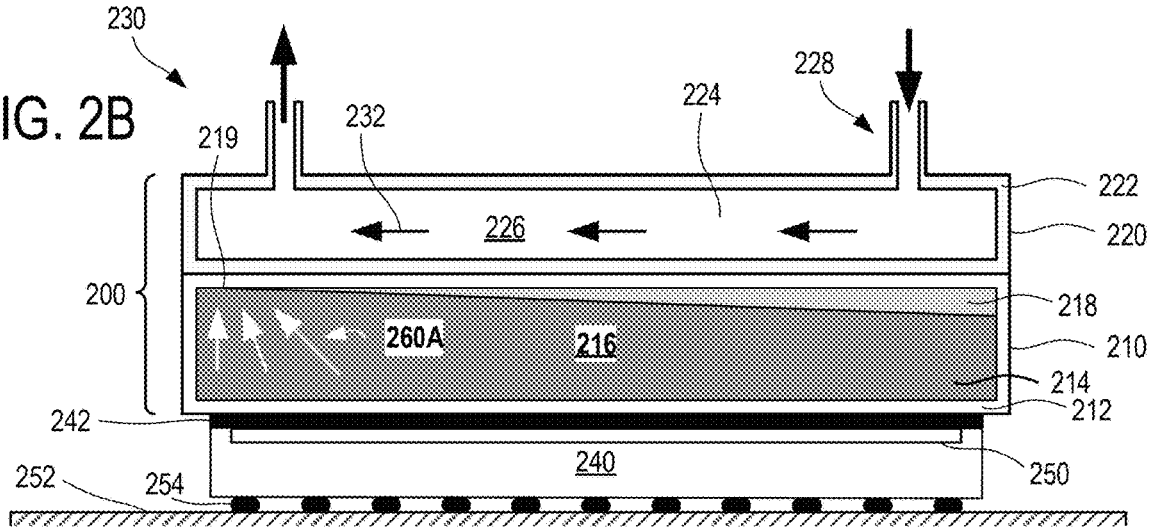
Figure 2C:
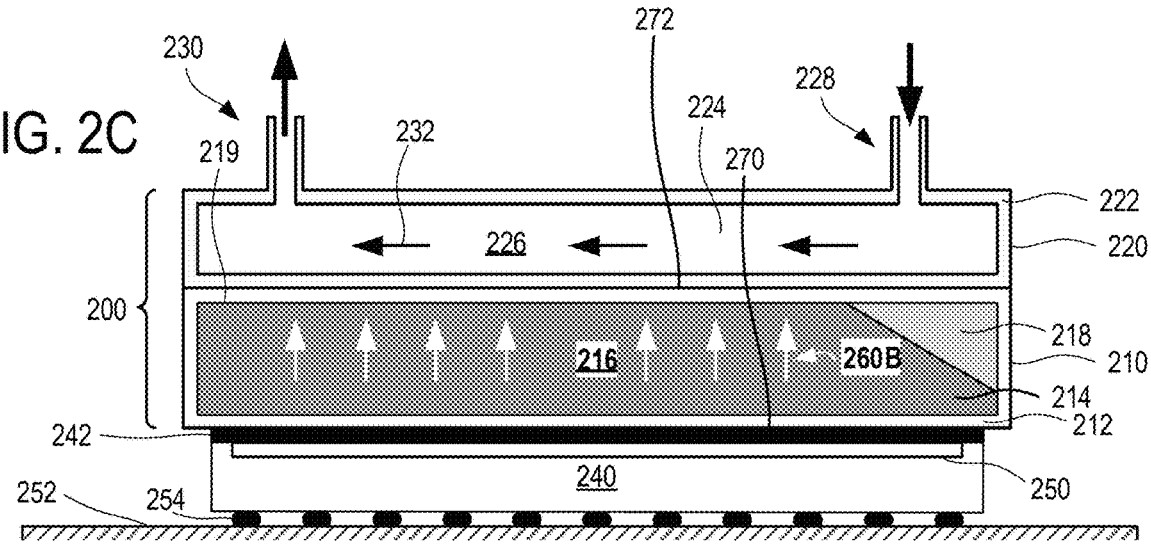

FIGS. 2A-2C illustrate cross-sectional views of an example VCHP-cold plate stack attached to a packaged integrated circuit component. The VCHP-cold plate stack 200 comprises a VCHP 210 physically coupled to a cold plate 220 and a packaged integrated circuit component 240. In some embodiments, the VCHP-cold plate stack 200 is a single integrated component. The VCHP 210 comprises a thermally conductive casing 212 that encloses a chamber 214 that comprises a working fluid 216 and a non-condensable gas 218. The cold plate 220 comprises a thermally conductive casing 222 that encloses a chamber 224 in which a cooling liquid 226 flows from a fluid inlet 228 to a fluid outlet 230. The direction of cooling liquid flow through the cold plate 220 is illustrated by arrows 232. The VCHP 210 is physically coupled to the component 240 by a thermal interface material (TIM) 242. The component 240 further comprises an integrated heat spreader 250 and is attached to a printed circuit board 252 via solder joints (e.g., solder balls) 254.

The working fluid 216 can be, for example, water, ammonia, methanol, refrigerants, or ethanol and the non-condensable gas 218 can be, for example, argon, nitrogen, carbon dioxide, or nitrogen. The packaged integrated circuit component 240 can comprise one or more integrated circuits described or referenced herein, such as a processor unit (e.g., system-on-a-chip (SoC), graphics processing unit (GPU), accelerator), voltage regulator, I/O controller, chipset processor, memory, storage device, or network interface controller).

FIG. 2A illustrates the VCHP-cold plate stack 200 when the component 240 is not operating or operating at low power levels. The non-condensable gas 218 is located against the coldest part of the VCHP 210, the part of the VCHP 210 attached to the cold plate 220. Due to the low thermal conductivity of the non-condensable gas 218, the non-condensable gas layer between the working fluid 216 and the cold plate 220 restricts the flow of heat from the component 240 to the cold plate 220. When the component 240 is operational and generates enough heat for the VCHP 210 to allow the working fluid 216 to be exposed to at least a portion of the cold plate 220, the component 240 is cooled through the heating of the cooling liquid 226 by heat generated by the component 240.

The non-condensable gas 218 is charged to a level such that a characteristic temperature of the component 240 is regulated to stay within a temperature range narrower than if a thermal management system employing negative feedback were not used. The characteristic temperature of the component can be, for example, a temperature of an exterior surface of the component package. In some embodiments, the characteristic temperature can be Tcase, the temperature of the integrated heat spreader 250. In other embodiments, the characteristic temperature can be the temperature of the solder joints 254.

FIG. 2B illustrates the VCHP-cold plate stack 200 when the component 240 is operating at a power level below TDP conditions and at which the non-condensable gas 218 is compressed enough by the working fluid 216 that the working fluid 216 is exposed to at least a portion of a first interior surface 219 of the chamber 214, thereby creating a low thermal resistance path across the VCHP 210 to allow the flow of heat from the component 240 to the cold plate 220, which is illustrated by arrows 260A. In some embodiments, the addition of the VCHP 210 to the thermal management solution does not degrade the performance of the cold plate 220 as the thermal resistance added by the VCHP 210 is small due to its high thermal conductivity when the VCHP heat switch is "on".

FIG. 2C illustrates the VCHP-cold plate stack 200 when the component 240 is operating under TDP conditions.

Under TDP conditions, the internal pressure of the working fluid 216 displaces the non-condensable gas 218 toward the cooler end of the VCHP chamber 214 (the end of the chamber 214 near the fluid inlet 228 of the cold plate 220) and exposes more of the cold plate 220 to the working fluid 216. This allows for a lower thermal resistance path for heat generated by the component 240 to follow than when the component 240 is operating in a lower power state, such as illustrated in FIG. 2B. The increased flow of heat is illustrated by the arrows 260B. The flow of heat through the VCHP 210 when the VCHP is "on" can be characterized by the flow of heat from a first exterior surface 270 of the VCHP 210 to a second exterior surface 272 of the VCHP 210, the first exterior surface 270 and the second exterior surface 272 being substantially parallel to and located opposite from (e.g., at least partially overlapping) each other.

Thus, as its name implies, the VCHP 210 provides for a path of variable thermal conductance between the component 240 and the cold plate 220 along the height of the VCHP 210.

As discussed above, the decreased thermal resistance of the VCHP 210 with increasing component heat generation provides negative feedback to the thermal system to regulate the characteristic temperature. That is, the more heat generated by the component 240, the more cooling of the component 240 that will occur, thus keeping the characteristic temperature from rising with increased component power consumption. And, the less heat generated by the component 240, the less cooling of the component 240 that the VCHP 210 will allow, thus keeping the characteristic temperature from dropping with decreasing component power consumption. In some embodiments, the characteristic temperature of the component 240 can be kept within a narrower temperature range than if a thermal management solution not providing negative feedback were used and the characteristic temperature allowed to scale with component power consumption.

By being able to keep the characteristic temperature of the component within a narrower temperature range, the solder joints 254 and other constituent components of the component 240 do not experience a high degree of thermal cycling, making it less likely that the component 240 will fail prematurely due to thermal cycling-induced failure.

Thus, and as described previously, the VCHP 210 can be thought of as a "passive heat switch" in that allows a variable amount of heat generated by the component 240 to flow to the cold plate 220. Generally, the heat switch is off when the component 240 is operating at lower levels to keep a characteristic temperature from dropping and the heat switch is on when the component is operating at a higher power level to prevent the characteristic temperature from rising.

Although FIGS. 2A-2C illustrate a VCHP-cold plate stack 200 as the thermal management solution for the packaged integrated circuit component 240, in other embodiments, other types of condensers could be used in place of a cold plate. For example, the VCHP 210 could be attached to a heat sink comprising a plurality of fins, such as the heat sink illustrated in FIGS. 1A-1B and a VCHP-heat sink stack could be provided as a single integrated component.

Figure 3A:
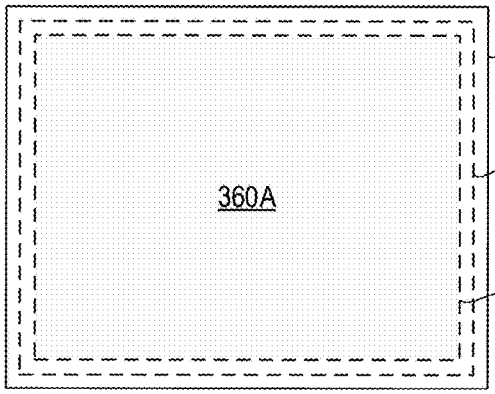
FIGS. 3A-3F illustrate top views and side cross-sectional views of three example configurations of a VCHP-cold plate stack physically coupled to an integrated circuit component.
Figure 3B:
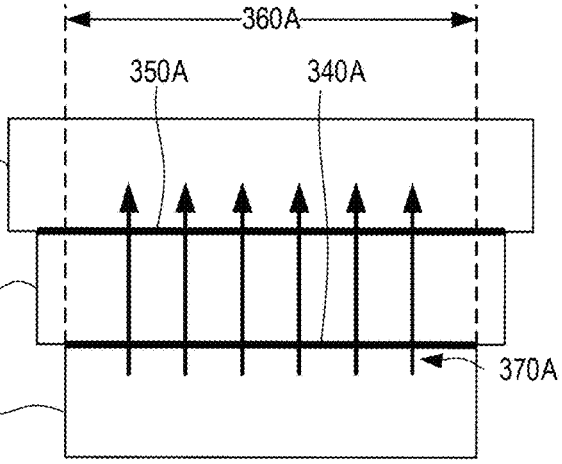

FIGS. 3A-3F illustrate top views and side cross-sectional view of three example configurations of a VCHP-cold plate stack physically coupled to an integrated circuit component. FIGS. 3A & 3B illustrate a VCHP 300A physically coupled to and located between a cold plate 310A and an integrated circuit component 320A. The VCHP 300A has a length and width lesser than that of the cold plate 310A and greater than that of the component 320A. The VCHP 300A is physically coupled to the component 320A and the cold plate 310A. The VCHP 300A physical coupling to the component 320A is associated with a first area 340A and the VCHP 300A physical coupling to the cold plate 310A is associated with a second area 350A. An overlap area 360A shows the extent to which the first area 340A and the second area 350A overlap. When the integrated circuit component 320A is operating under TDP conditions, the VCHP 300A is on and heat predominantly flows from the component 320A to the cold plate 310A through a region of the VCHP 300A defined by the overlap area 360A, as illustrated by arrows 370A.

Figure 3C:
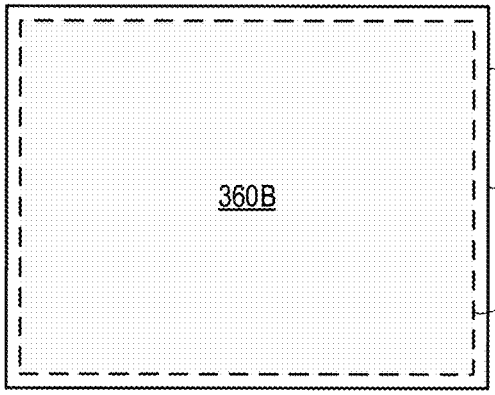
Figure 3D:
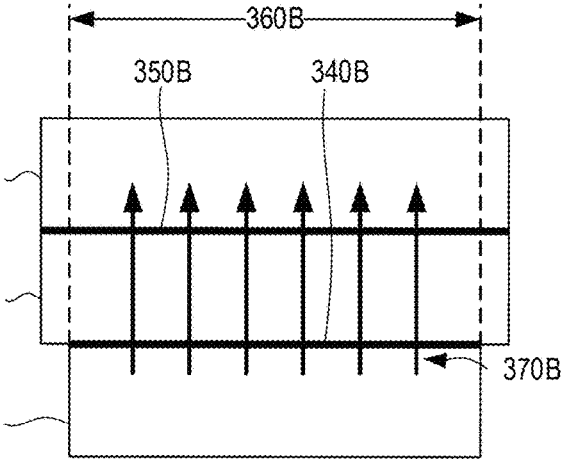

FIGS. 3C & 3D illustrate a VCHP 300B physically coupled to and located between a cold plate 310B and an integrated circuit component 320B. The VCHP 300B has a length and width that is the same as the cold plate 310B and greater than that of the component 320B. The VCHP 300B is physically coupled to the component 320B and the cold plate 310B. The VCHP 300B physical coupling to the component 320B is associated with a first area 340B and the VCHP 300B physical coupling to the cold plate 310B is associated with a second area 350B. An overlap area 360B shows the extent to which the first area 340B and the second area 350B overlap. When the integrated circuit component 320B is operating under TDP conditions, the VCHP 300B is on and heat predominantly flows from the component 320B to the cold plate 310B through a region of the VCHP 300B defined by the overlap area 360B, as illustrated by arrows 370B.

Figure 3E:
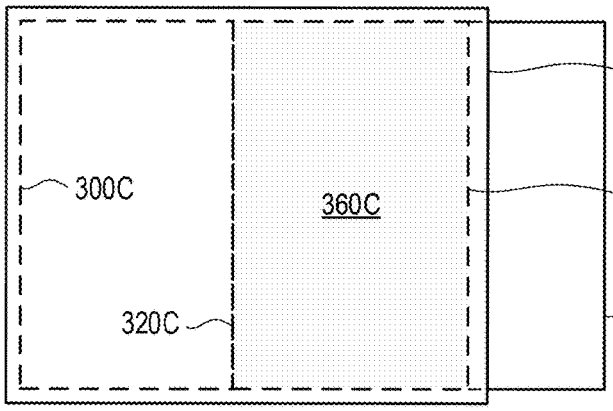
Figure 3F:
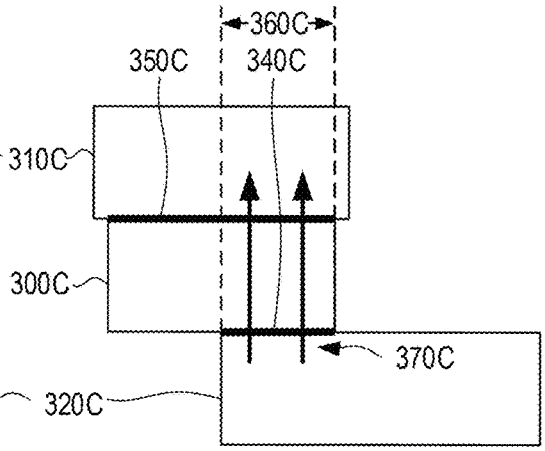

FIGS. 3E & 3F illustrate a VCHP 300C physically coupled to and located between a cold plate 310C and an integrated circuit component 320C. The VCHP 300C has a slightly lesser length and width than the cold plate 310C and the VCHP 300C overlaps only a portion of the component 320C. The VCHP 300C is physically coupled to the component 320C over a first area 340C and is physically coupled to the cold plate 310C over a second area 350C. The VCHP 300C physical coupling to the component 320C is associated with a first area 340C and the VCHP 300C physical coupling to the cold plate 310C is associated with a second area 350C. An overlap area 360C shows the extent to which the first area 340C and the second area 350C overlap. When the integrated circuit component 320C is operating under TDP conditions, the VCHP 300C is on and heat predominantly flows from the component 320C to the cold plate 310C through a volume of the VCHP 300C defined by the overlap area 360C, as illustrated by arrows 370C.

Any of the VCHPs, 300A, 300B, or 300C can be any VCHP described or referenced herein (e.g., VCHP 210), any of the integrated circuit components 320A, 320B, or 320C can be any integrated circuit component described or referenced herein (e.g., component 240), and any of the cold plates 310A, 310B, or 310C can be any cold plate described or referenced herein (e.g., cold plate 220).

In embodiments where a VCHP is combined with a cold plate as part of a thermal management solution, the thermal management solution can further comprise a heat exchanger, pump, and one or more conduits (e.g., metal tubes) that create a loop that connects the cold plate, heat exchanger, and pump. The pump circulates a cooling liquid through the conduit loop and the heat exchanger cools the cooling liquid that has been heated by integrated circuit components as it flows through the cold plate before the pump returns the cooling liquid to the cold plate to be heated again. In some embodiments, the heat exchanger, pump, and conduits reside within a single housing, such as in a stand-alone computing system (e.g., personal computer, server, or workstation), or a rack-level (e.g., blade, tray, blade) computing solution (e.g., rack server, hyper-converged infrastructure (HCI) server). Multiple integrated circuit components contained in a single housing can be physically coupled to multiple VCHP-cold plate stacks to provide component cooling, with each VCHP-cold plate stack cooling one or more integrated circuit components. Multiple cold plates, with each cold plate providing cooling to one or more integrated circuit components can be connected via conduits within a system. In some embodiments, the heat exchanger and pump are located external to the housing in which the integrated circuit, VCHP and cold plate are enclosed, such as in a rack system where the heat exchanger and pump are part of the thermal management solution for multiple sleds, blades, or trays within a rack or across racks.

Figure 4:
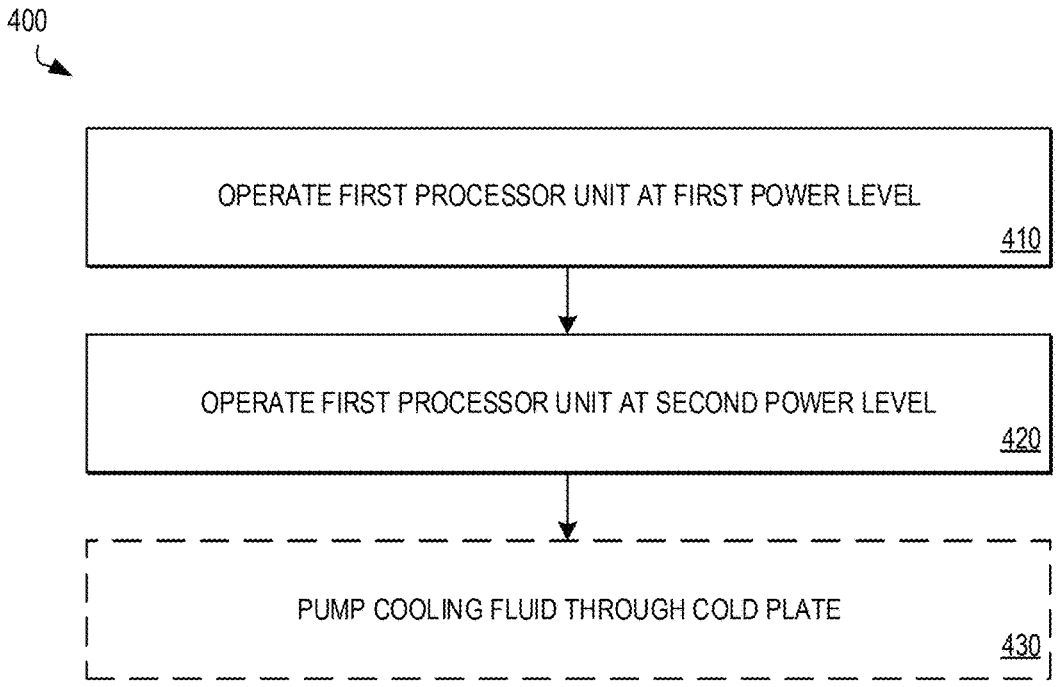
FIG. 4 is an example method of operating a computing system comprising an integrated circuit component and a thermal management solution comprising a VCHP and a cold plate.

FIG. 4 is an example method of operating a computing system comprising an integrated circuit component and a thermal management solution comprising a VCHP and a cold plate. The method 400 could be performed by, for example, a rack server comprising a VCHP (e.g., 220, 300A, 300B, 300C) and a cold plate (e.g., 220, 310A, 310B, 310C) comprising an integrated circuit package (e.g., 140, 210, 320A, 320B, 320C) comprising a plurality of processing units. At 410, a first processor unit of a plurality of processor units is operated at first power level, the plurality of processor units located in an integrated circuit component. At 420, a first processor unit is operated at a second power level, the first power level lesser than the second power level, the integrated circuit component physically coupled to a variable conductance heat pipe (VCHP), the VCHP located between the integrated circuit component and a cold plate, the VCHP physically coupled to the cold plate, the VCHP to allow a first rate of heat transfer between the integrated circuit component and the cold plate when the first processor unit is operated at the first power level and a second rate of heat transfer between the integrated circuit component and the cold plate when the first processor unit is operated at the second power level, the first rate of heat transfer less than the second rate of heat transfer. The method 400 can optionally include additional elements, such as pumping a cooling liquid through the cold plate at 430.

The technologies, techniques and embodiments described herein can be performed by or implemented in any of a variety of computing systems, such as laptop computers, (e.g., 2-in-1 laptops, convertible laptops), desktop computers, servers, workstations, gaming consoles, and rack-level computing solutions (e.g., blades, trays, sleds). As used herein, the term "computing systems" includes computing devices and includes systems comprising multiple discrete physical components. In some embodiments, the computing systems are located in a data center, such as an enterprise data center (e.g., a data center owned and operated by a company and typically located on company premises), managed services data center (e.g., a data center managed by a third party on behalf of a company), a colocated data center (e.g., a data center in which data center infrastructure is provided by the data center host and a company provides and manages their own data center components (servers, etc.)), cloud data center (e.g., a data center operated by a cloud services provider that host companies applications and data), and an edge data center (e.g., a data center, typically having a smaller footprint than other data center types, located close to the geographic area that it serves).

Figure 5:
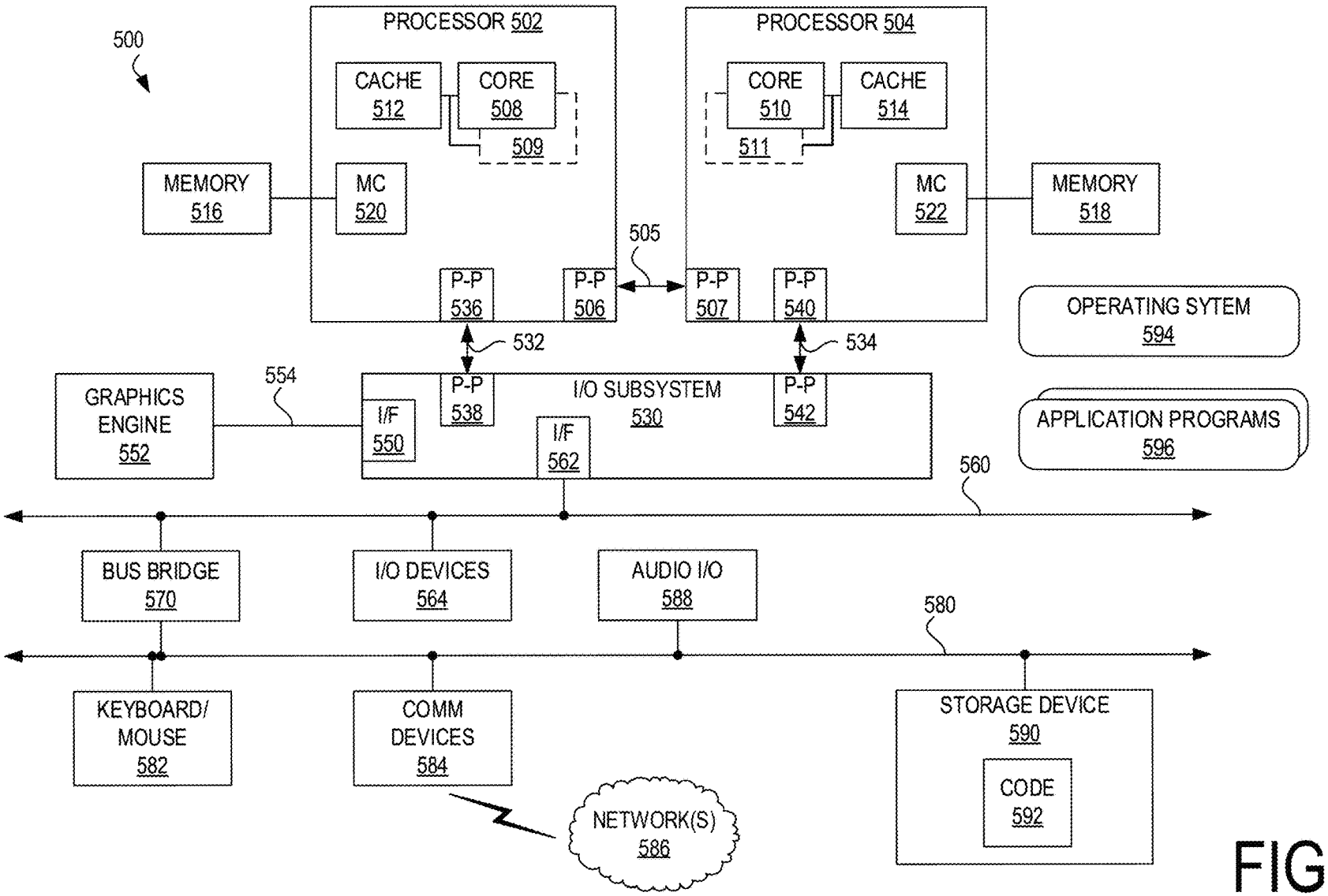
FIG. 5 is a block diagram of an exemplary computing system in which technologies described herein may be implemented.

FIG. 5 is a block diagram of an exemplary computing system in which technologies described herein may be implemented. Generally, components shown in FIG. 5 can communicate with other shown components, although not all connections are shown, for ease of illustration. The system 500 is a multiprocessor system comprising a first processor unit 502 and a second processor unit 504 and is illustrated as comprising point-to-point (P-P) interconnects. For example, a point-to-point (P-P) interface 506 of the processor unit 502 is coupled to a point-to-point interface 507 of the processor unit 504 via a point-to-point interconnection 505. It is to be understood that any or all of the point-to-point interconnects illustrated in FIG. 5 can be alternatively implemented as a multi-drop bus, and that any or all buses illustrated in FIG. 5 could be replaced by point-to-point interconnects.

As shown in FIG. 5, the processor units 502 and 504 are multicore processors. Processor unit 502 comprises processor cores 508 and 509, and processor unit 504 comprises processor cores 510 and 511. Processor cores 508-511 can execute computer-executable instructions in a manner similar to that discussed below in connection with FIG. 6, or in other manners.

Processor units 502 and 504 further comprise at least one shared cache memory 512 and 514, respectively. The shared caches 512 and 514 can store data (e.g., instructions) utilized by one or more components of the processor, such as the processor cores 508-509 and 510-511. The shared caches 512 and 514 can be part of a memory hierarchy for the system 500. For example, the shared cache 512 can locally store data that is also stored in a memory 516 to allow for faster access to the data by components of the processor 502. In some embodiments, the shared caches 512 and 514 can comprise multiple cache layers, such as level 1 (L1), level 2 (L2), level 3 (L3), level 4 (L4), and/or other caches or cache layers, such as a last level cache (LLC).

Although the system 500 is shown with two processor units, the system 500 can comprise any number of processor units. Further, a processor unit can comprise any number of processor cores. A processor unit can comprise a central processing unit, a controller, a graphics processor, an accelerator (such as a graphics accelerator, digital signal processor (DSP), or AI accelerator)). In some embodiments, a processor unit include an XPU (or xPU). An XPU can comprise one or more of: a graphics processing unit (GPU), general purpose GPU (GPGPU), field programmable gate arrays (FPGA), accelerated processing unit (APU), neural network processing unit (NPU), accelerator, or other processor. In some embodiments, a processor unit can comprise a data processor unit (DPU).

In some embodiments, the system 500 or an integrated circuit package can comprise one or more processor units that are heterogeneous or asymmetric to a first processor, accelerator, FPGA, or any other processor unit. There can be a variety of differences between the processing units in a system in terms of a spectrum of metrics of merit including architectural, microarchitectural, thermal, power consumption characteristics and the like. These differences can effectively manifest themselves as asymmetry and heterogeneity amongst the processor units in a system. In some embodiments, the processor units 502 and 504 reside in the same integrated circuit package. As used herein, the terms "processor unit" and "processing unit" can refer to any processor, processor core, component, module, engine, circuitry or any other processing element described herein.

Processor units 502 and 504 further comprise memory controller logic (MC) 520 and 522. As shown in FIG. 5, MCs 520 and 522 control memories 516 and 518 coupled to the processor units 502 and 504, respectively. The memories 516 and 518 can comprise various types of memories, such as volatile memory (e.g., dynamic random-access memories (DRAM), static random-access memory (SRAM)) or non-volatile memory (e.g., flash memory, solid-state drives, chalcogenide-based phase-change non-volatile memories). While MCs 520 and 522 are illustrated as being integrated into the processor units 502 and 504, in alternative embodiments, the MCs can be logic external to a processor unit, and can comprise one or more layers of a memory hierarchy.

Processor units 502 and 504 are coupled to an Input/Output (I/O) subsystem 530 via point-to-point interconnections 532 and 534. The point-to-point interconnection 532 connects a point-to-point interface 536 of the processor unit 502 with a point-to-point interface 538 of the I/O subsystem 530, and the point-to-point interconnection 534 connects a point-to-point interface 540 of the processor unit 504 with a point-to-point interface 542 of the I/O subsystem 530. Input/Output subsystem 530 further includes an interface 550 to couple I/O subsystem 530 to a graphics engine 552, which can be a high-performance graphics engine. The I/O subsystem 530 and the graphics engine 552 are coupled via a bus 554. Alternately, the bus 554 could be a point-to-point interconnection.

Input/Output subsystem 530 is further coupled to a first bus 560 via an interface 562. The first bus 560 can be a Peripheral Component Interconnect (PCI) bus, a PCI Express bus, or any other type of bus.

Various I/O devices 564 can be coupled to the first bus 560. A bus bridge 570 can couple the first bus 560 to a second bus 580. In some embodiments, the second bus 580 can be a low pin count (LPC) bus. Various devices can be coupled to the second bus 580 including, for example, a keyboard/mouse 582, audio I/O devices 588 and a storage device 590, such as a hard disk drive, solid-state drive or other storage device for storing computer-executable instructions (code) 592. The code 592 can comprise computer-executable instructions for performing technologies described herein. Additional components that can be coupled to the second bus 580 include communication device(s) 584, which can provide for communication between the system 500 and one or more wired or wireless networks 586 (e.g. Wi-Fi, cellular or satellite networks) via one or more wired or wireless communication links (e.g., wire, cable, Ethernet connection, radio-frequency (RF) channel, infrared channel, Wi-Fi channel) using one or more communication standards (e.g., IEEE 502.11 standard and its supplements).

The system 500 can comprise removable memory such as flash memory cards (e.g., SD (Secure Digital) cards), memory sticks, Subscriber Identity Module (SIM) cards). The memory in system 500 (including caches 512 and 514, memories 516 and 518 and storage device 590) can store data and/or computer-executable instructions for executing an operating system 594 and application programs 596. Example data includes web pages, text messages, images, sound files and video data to be sent to and/or received from one or more network servers or other devices by the system 500 via one or more wired or wireless networks, or for use by the system 500. The system 500 can also have access to external memory (not shown) such as external hard drives or cloud-based storage.

The operating system 594 can control the allocation and usage of the components illustrated in FIG. 5 and support one or more application programs 596. The application programs 596 can include common mobile computing device applications (e.g., email applications, calendars, contact managers, web browsers, messaging applications) as well as other computing applications.

The system 500 can support various input devices, such as a touchscreen, microphone, monoscopic camera, stereoscopic camera, trackball, touchpad, trackpad, mouse, keyboard, proximity sensor, light sensor, electrocardiogram (ECG) sensor, PPG (photoplethysmogram) sensor, galvanic skin response sensor, and one or more output devices, such as one or more speakers or displays. Other possible input and output devices include piezoelectric and other haptic I/O devices. Any of the input or output devices can be internal to, external to or removably attachable with the system 500. External input and output devices can communicate with the system 500 via wired or wireless connections.

In addition, the computing system 500 can provide one or more natural user interfaces (NUIs). For example, the operating system 594 or applications 596 can comprise speech recognition logic as part of a voice user interface that allows a user to operate the system 500 via voice commands. Further, the system 500 can comprise input devices and logic that allows a user to interact with the system 500 via body, hand or face gestures.

The system 500 can further comprise one or more communication components 584. The components 584 can comprise wireless communication components coupled to one or more antennas to support communication between the system 500 and external devices. The wireless communication components can support various wireless communication protocols and technologies such as Near Field Communication (NFC), IEEE 1002.11 (Wi-Fi) variants, WiMax, Bluetooth, Zigbee, 4G Long Term Evolution (LTE), Code Division Multiplexing Access (CDMA), Universal Mobile Telecommunication System (UMTS) and Global System for Mobile Telecommunication (GSM). In addition, the wireless modems can support communication with one or more cellular networks for data and voice communications within a single cellular network, between cellular networks, or between the mobile computing device and a public switched telephone network (PSTN).

The system 500 can further include at least one input/output port (which can be, for example, a USB, IEEE 1394 (FireWire), Ethernet and/or RS-232 port) comprising physical connectors; a power supply (such as a rechargeable battery); a satellite navigation system receiver, such as a GPS receiver; a gyroscope; an accelerometer; a proximity sensor; and a compass. A GPS receiver can be coupled to a GPS antenna. The system 500 can further include one or more additional antennas coupled to one or more additional receivers, transmitters and/or transceivers to enable additional functions.

It is to be understood that FIG. 5 illustrates only one exemplary computing system architecture. Computing systems based on alternative architectures can be used to implement technologies described herein. For example, instead of the processors 502 and 504, and the graphics engine 552 being located on discrete integrated circuits, a computing device can comprise a SoC (system-on-a-chip) integrated circuit incorporating multiple processors, a graphics engine and additional components. Further, a computing device can connect elements via bus or point-to-point configurations different from that shown in FIG. 5. Moreover, the illustrated components in FIG. 5 are not required or all-inclusive, as shown components can be removed and other components added in alternative embodiments.

Figure 6:
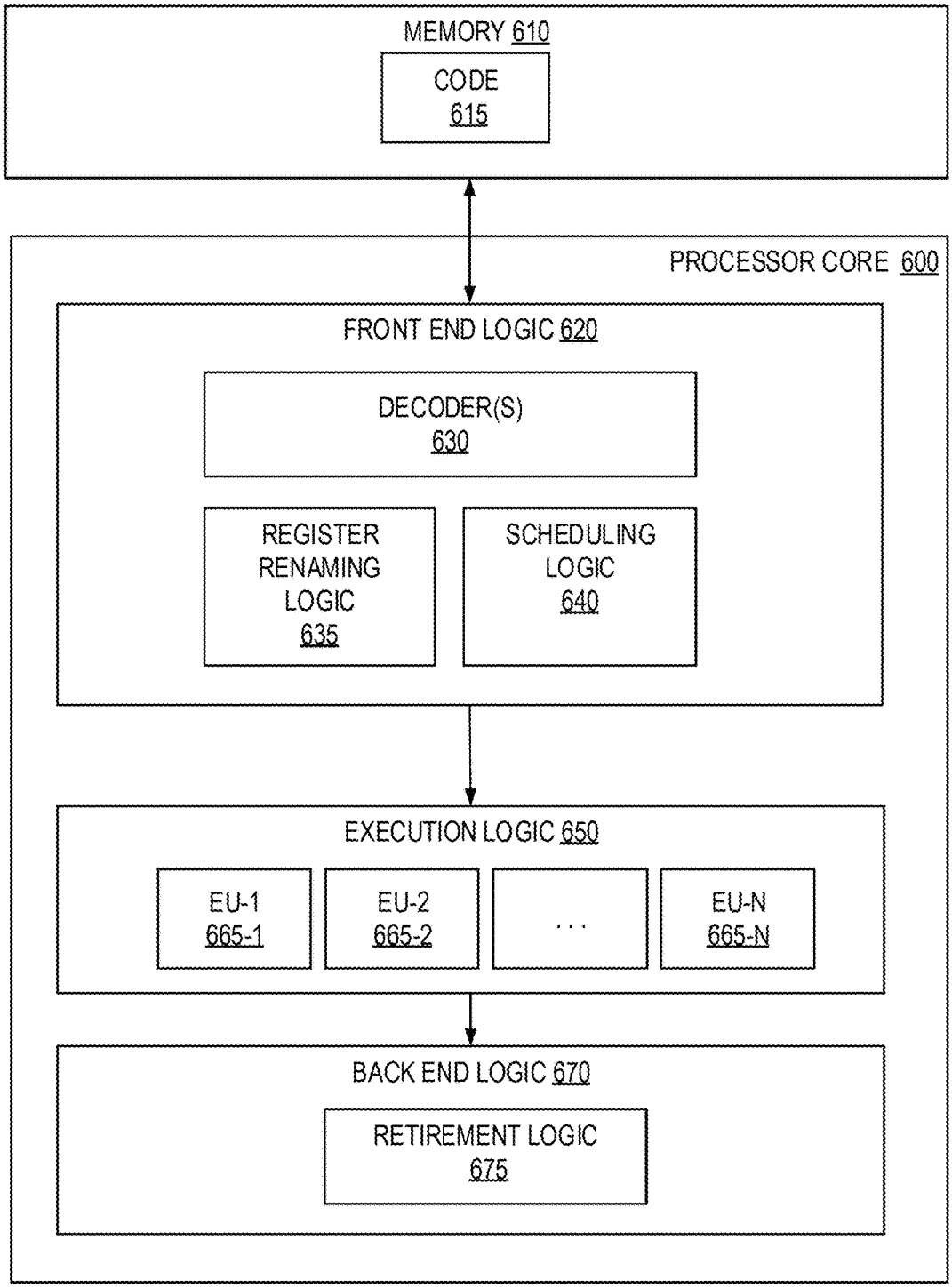
FIG. 6 is a block diagram of an exemplary processor unit that can execute instructions as part of implementing technologies described herein.

FIG. 6 is a block diagram of an exemplary processing unit 600 to execute computer-executable instructions as part of implementing technologies described herein. The processing unit 600 can be a processing unit for any type of processor, such as a microprocessor, an embedded processor, a digital signal processor (DSP) or a network processor. The processing unit 600 can be a single-threaded core or a multi-threaded core in that it may include more than one hardware thread context (or "logical processor") per processing unit.

FIG. 6 also illustrates a memory 610 coupled to the processing unit 600. The memory 610 can be any memory described herein or any other memory known to those of skill in the art. The memory 610 can store computer-executable instruction 615 (code) executable by the processor unit 600.

The processing unit comprises front-end logic 620 that receives instructions from the memory 610. An instruction can be processed by one or more decoders 630. The decoder 630 can generate as its output a micro operation such as a fixed width micro operation in a predefined format, or generate other instructions, microinstructions, or control signals, which reflect the original code instruction. The front-end logic 620 further comprises register renaming logic 635 and scheduling logic 640, which generally allocate resources and queues operations corresponding to converting an instruction for execution.

The processing unit 600 further comprises execution logic 650, which comprises one or more execution units (EUs) 665-1 through 665-N. Some processing unit embodiments can include a number of execution units dedicated to specific functions or sets of functions. Other embodiments can include only one execution unit or one execution unit that can perform a particular function. The execution logic 650 performs the operations specified by code instructions. After completion of execution of the operations specified by the code instructions, back-end logic 670 retires instructions using retirement logic 675. In some embodiments, the processing unit 600 allows out of order execution but requires in-order retirement of instructions. Retirement logic 675 can take a variety of forms as known to those of skill in the art (e.g., re-order buffers or the like).

The processing unit 600 is transformed during execution of instructions, at least in terms of the output generated by the decoder 630, hardware registers and tables utilized by the register renaming logic 635, and any registers (not shown) modified by the execution logic 650. Although not illustrated in FIG. 6, a processing unit can include other elements on an integrated chip with the processing unit 600. For example, a processing unit may include additional elements such as memory control logic, one or more graphics engines, I/O control logic and/or one or more caches.

As used in any embodiment herein, the term "module" refers to logic that may be implemented in a hardware component or device, software or firmware running on a processor, or a combination thereof, to perform one or more operations consistent with the present disclosure. Software may be embodied as a software package, code, instructions, instruction sets and/or data recorded on non-transitory computer readable storage mediums. Firmware may be embodied as code, instructions or instruction sets and/or data that are hard-coded (e.g., nonvolatile) in memory devices. As used in any embodiment herein, the term "circuitry" can comprise, for example, singly or in any combination, hardwired circuitry, programmable circuitry such as computer processors comprising one or more individual instruction processing cores, state machine circuitry, and/or firmware that stores instructions executed by programmable circuitry. Modules described herein may, collectively or individually, be embodied as circuitry that forms a part of one or more devices. Thus, any of the modules can be implemented as circuitry. A computing system referred to as being programmed to perform a method can be programmed to perform the method via software, hardware, firmware or combinations thereof.

Any of the disclosed methods can be implemented as computer-executable instructions or a computer program product. Such instructions can cause a computer or one or more processor units capable of executing computer-executable instructions to perform any of the disclosed methods. Generally, as used herein, the term "computer" refers to any computing device or system described or mentioned herein, or any other computing device. Thus, the term "computer-executable instruction" refers to instructions that can be executed by any computing device described or mentioned herein, or any other computing device.

The computer-executable instructions or computer program products as well as any data created and used during implementation of the disclosed technologies can be stored on one or more tangible or non-transitory computer-readable storage media, such as optical media discs (e.g., DVDs, CDs), volatile memory components (e.g., DRAM, SRAM), or non-volatile memory components (e.g., flash memory, solid-state drives, chalcogenide-based phase-change non-volatile memories). Computer-readable storage media can be contained in computer-readable storage devices such as solid-state drives, USB flash drives, and memory modules. Alternatively, the computer-executable instructions may be performed by specific hardware components that contain hardwired logic for performing all or a portion of disclosed methods, or by any combination of computer-readable storage media and hardware components.

The computer-executable instructions can be part of, for example, a dedicated software application or a software application that is accessed via a web browser or other software application (such as a remote computing application). Such software can be read and executed by, for example, a single computing device or in a network environment using one or more networked computers. Further, it is to be understood that the disclosed technology is not limited to any specific computer language or program. For instance, the disclosed technologies can be implemented by software written in C++, Java, Perl, Python, JavaScript, Adobe Flash, or any other suitable programming language. Likewise, the disclosed technologies are not limited to any particular computer or type of hardware.

Furthermore, any of the software-based embodiments (comprising, for example, computer-executable instructions for causing a computer to perform any of the disclosed methods) can be uploaded, downloaded or remotely accessed through a suitable communication means. Such suitable communication means include, for example, the Internet, the World Wide Web, an intranet, cable (including fiber optic cable), magnetic communications, electromagnetic communications (including RF, microwave, and infrared communications), electronic communications, or other such communication means.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrase "at least one of A, B or C" can mean A; B; C; A and B; A and C; B and C; or A, B and C. Moreover, as used in this application and in the claims, a list of items joined by the term "one or more of" can mean any combination of the listed terms. For example, the phrase "one or more of A, B and C" can mean A; B; C; A and B; A and C; B and C; or A, B, and C.

The disclosed methods, apparatuses and systems are not to be construed as limiting in any way. Instead, the present disclosure is directed toward all novel and nonobvious features and aspects of the various disclosed embodiments, alone and in various combinations and subcombinations with one another. The disclosed methods, apparatuses, and systems are not limited to any specific aspect or feature or combination thereof, nor do the disclosed embodiments require that any one or more specific advantages be present or problems be solved.

Theories of operation, scientific principles or other theoretical descriptions presented herein in reference to the apparatuses or methods of this disclosure have been provided for the purposes of better understanding and are not intended to be limiting in scope. The apparatuses and methods in the appended claims are not limited to those apparatuses and methods that function in the manner described by such theories of operation.

Although the operations of some of the disclosed methods are described in a particular, sequential order for convenient presentation, it is to be understood that this manner of description encompasses rearrangement, unless a particular ordering is required by specific language set forth herein. For example, operations described sequentially may in some cases be rearranged or performed concurrently. Moreover, for the sake of simplicity, the attached figures may not show the various ways in which the disclosed methods can be used in conjunction with other methods.

Additional examples of the presently described VCHP embodiments include the following, non-limiting implementations. Each of the following non-limiting examples may stand on its own or may be combined in any permutation or combination with any one or more of the other examples provided below or throughout the present disclosure.

Example 1 is an apparatus comprising: an integrated circuit component comprising one or more integrated circuits; a cold plate; and a variable conductance heat pipe (VCHP) located between the integrated circuit component and the cold plate, the VCHP physically coupled to the integrated circuit component, the VCHP physical coupling to the cold plate associated with a first area, the VCHP physical coupling to the integrated circuit component associated with a second area, the first area at least partially overlapping the second area.

Example 2 includes the apparatus of Example 1, wherein the one or more integrated circuits comprise one or more processing units.

Example 3 includes the apparatus of Example 1, wherein the one or more integrated circuits comprise one or more instances of a first integrated circuit and one or more instances of a second integrated circuit, the first integrated circuit different from the second integrated circuit.

Example 4 includes the apparatus of any one of Examples 1-3, wherein the one or more integrated circuits comprise one or more chiplets.

Example 5 includes the apparatus of any one of Examples 1-4, wherein the integrated circuit component comprises a package containing the one or more integrated circuits.

Example 6 includes the apparatus of Example 5, wherein a plurality of solder balls are located on an exterior surface of the package.

Example 7 includes the apparatus of Example 5, wherein a plurality of pads are located on an exterior surface of the package.

Example 8 includes the apparatus of Example 5, wherein a plurality of pins are located on an exterior surface of the package.

Example 9 includes the apparatus of any one of Examples 1-4, wherein the integrated circuit component comprises a plurality of contacts and a plurality of solder bumps attached to the contacts.

Example 10 includes the apparatus of any one of Examples 1-9, further comprising a printed circuit board, the integrated circuit component physically coupled to the printed circuit board.

Example 11 includes the apparatus of Example 10, wherein the integrated circuit component is physically coupled to the printed circuit board via a plurality of solder joints.

Example 12 apparatus of any one of Examples 1-10, wherein the integrated circuit component further comprises an integrated heat spreader located adjacent to the VCHP.

Example 13 apparatus of any one of Examples 1-12, wherein the integrated circuit component is physically coupled to the cold plate by a thermal interface material.

Example 14 apparatus of any one of Examples 1-13, further comprising: a heat exchanger; a pump; and one or more conduits to carry a cooling liquid, the conduits arranged to create a loop comprising the heat exchanger and the cold plate.

Example 15 apparatus of any one of Examples 1-14, further comprising a housing containing the integrated circuit component, the cold plate, the VCHP, the heat exchanger and the pump.

Example 16 apparatus of any one of Examples 1-14, further comprising a housing, wherein the integrated circuit component, the cold plate, and the VCHP are contained in the housing and the heat exchanger and the pump are located external to the housing.

Example 17 is an apparatus comprising: an integrated circuit component comprising one or more integrated circuits; a cold plate; and a heat switch means to allow a variable amount of heat to flow from the integrated circuit component to the cold plate, the variable amount of heat based on an amount of heat generated by the integrated circuit component.

Example 18 is the apparatus of Example 17, wherein the one or more integrated circuits comprise one or more processing units.

Example 19 is the apparatus of Example 17, wherein the one or more integrated circuits comprise one or more instances of a first integrated circuit and one or more instances of a second integrated circuit, the first integrated circuit different from the second integrated circuit.

Example 20 is the apparatus of any one of Examples 17-19, wherein the integrated circuit component comprises a package containing the one or more integrated circuits.

Example 21 is the apparatus of Example 20, wherein a plurality of solder balls are located on an exterior surface of the package.

Example 22 is the apparatus of one of Examples 17-21, further comprising a printed circuit board, the integrated circuit component physically coupled to the printed circuit board.

Example 23 is the apparatus of Example 22, wherein the integrated circuit component is physically coupled to the printed circuit board via a plurality of solder joints.

Example 24 is the apparatus of one of Examples 17-23, further comprising: a heat exchanger; a pump; and one or more conduits to carry a cooling liquid, the conduits arranged to create a loop comprising the heat exchanger and the cold plate.

Example 25 is the apparatus of Example 24, further comprising a housing containing the integrated circuit component, the cold plate, the heat switch means, the heat exchanger and the pump.

Example 26 is the apparatus of Example 24, further comprising a housing, wherein the integrated circuit component, the cold plate, and the heat switch means, are contained within the housing and the heat exchanger and the pump are located external to the housing.

Example 27 is a method comprising: operating a first processor unit of a plurality of processor units of an integrated circuit component at first power level, the plurality of processor units located in an integrated circuit component; and operating the first processor unit at a second power level, the first power level lesser than the second power level, the integrated circuit component physically coupled to a variable conductance heat pipe (VCHP), the VCHP located between the integrated circuit component and a cold plate, the VCHP physically coupled to the cold plate, the VCHP to allow a first rate of heat transfer between the integrated circuit component and the cold plate when the first processor unit is operated at the first power level and a second rate of heat transfer between the integrated circuit component and the cold plate when the first processor unit is operated at the second power level, the first rate of heat transfer less than the second rate of heat transfer.

Example 28 is the method of Example 27, further comprising pumping a cooling liquid through the cold plate.

Example 29 is the method of Example 27, wherein the integrated circuit component comprise one or more instances of the first processor unit and one or more instances of a second processor unit, the first processor unit different from the second processor unit.

Example 30 is the method of any of Examples 27-29, wherein the integrated circuit component comprises a package containing the first processor unit.

Example 31 is the method of any of Examples 27-29, further comprising a printed circuit board, the integrated circuit component physically coupled to the printed circuit board.

Example 32 is the method of Example 31, wherein the integrated circuit component is physically coupled to the printed circuit board via a plurality of solder joints.

Example 33 is the method of any of Examples 27-32, wherein one or more conduits carry a cooling liquid, the conduits arranged to create a loop comprising a heat exchanger, a pump, and the cold plate Example 34 is the method of any of Examples 27-33, further comprising a housing containing the integrated circuit component, the cold plate, the VCHP, the heat exchanger and the pump.

Example 35 is the method of any of Examples 27-33, further comprising a housing, wherein the integrated circuit component, the cold plate, and the VCHP, are contained inside the housing and the heat exchanger and the pump are located within the housing.

Example 36 is an apparatus comprising: a cold plate; and a variable conductance heat pipe (VCHP) comprising a first exterior surface and a second exterior surface, the first exterior surface and the second exterior surface being substantially parallel to each other and located opposite from each other, the VCHP physically coupled to the cold plate at the exterior first surface; wherein, when the apparatus is physically coupled to an integrated circuit component at the second exterior surface, heat generated by the integrated circuit component flows through the VCHP from at least a portion of the second exterior surface to at least a portion of the first exterior surface.

Example 37 is the apparatus of Example 36, wherein the integrated circuit component comprises one or more integrated circuits.

Example 38 is the apparatus of Example 37, wherein the one or more integrated circuits comprise one or more processing units.

Example 39 is the apparatus of any one of Examples 36-38, wherein the one or more integrated circuits comprise one or more instances of a first integrated circuit and one or more instances of a second integrated circuit, the first integrated circuit different from the second integrated circuit.

Example 40 is the apparatus of any one of Examples 36-38, wherein the one or more integrated circuits comprise one or more chiplets.

Example 41 is the apparatus of any one of Examples 36-38, wherein the integrated circuit component comprises a package containing the one or more integrated circuits.

Example 42 is the apparatus of Example 41, wherein a plurality of solder balls are located on an exterior surface of the package.

Example 43 is the apparatus of Example 41, wherein a plurality of pads are located on an exterior surface of the package.

Example 44 is the apparatus of Example 41, wherein a plurality of pins are located on an exterior surface of the package.

Example 45 is the apparatus of any one of Examples 36-44, wherein the integrated circuit component comprises a plurality of contacts and a plurality of solder bumps attached to the contacts.

Example 46 is the apparatus of any one of Examples 36-44, further comprising a printed circuit board, the integrated circuit component physically coupled to the printed circuit board.

Example 47 is the apparatus of Example 46, wherein the integrated circuit component is physically coupled to the printed circuit board via a plurality of solder joints.

Example 48 is the apparatus of any one of claims 36-47, wherein the integrated circuit component further comprises an integrated heat spreader located adjacent to the VCHP.

Example 49 is the apparatus of any one of Examples 36-48, wherein the integrated circuit component is physically coupled to the cold plate by a thermal interface material.

Example 50 includes a system comprises one or more means to implement one or more of the methods of the Examples herein above.

Example 51 includes one or more non-transitory computer-readable storage media storing computer-executable instructions for causing a mobile computing device to perform any one of the methods of the Examples herein above.

We claim:

1. A method comprising:

operating a first processor unit of a plurality of processor units of an integrated circuit component at a first power level, the plurality of processor units located in an integrated circuit component; and operating the first processor unit at a second power level, the first power level lesser than the second power level, the integrated circuit component physically coupled to a variable conductance heat pipe (VCHP), the VCHP comprising a first exterior surface and a second exterior surface, the first exterior surface and the second exterior surface being substantially parallel to each other and located opposite from each other, the VCHP located between the integrated circuit component and a cold plate, the VCHP directly attached to the cold plate at the first exterior surface, the direct attachment of the VCHP to the cold plate associated with a first area, the VCHP physically coupled to the integrated circuit component at the second exterior surface, the physical coupling of the VCHP to the integrated circuit component associated with a second area that at least partially overlaps the first area, the VCHP to allow a first rate of heat transfer between the integrated circuit component and the cold plate when the first processor unit is operated at the first power level and a second rate of heat transfer between the integrated circuit component and the cold plate when the first processor unit is operated at the second power level, the first rate of heat transfer less than the second rate of heat transfer.

2. The method of claim 1, further comprising pumping a cooling liquid through the cold plate.

3. The method of claim 1, wherein the integrated circuit component comprises one or more instances of the first processor unit and one or more instances of a second processor unit, the first processor unit different from the second processor unit.

4. The method of claim 1, wherein one or more conduits carry a cooling liquid, the one or more conduits arranged to create a loop comprising a heat exchanger, a pump, and the cold plate.

5. An apparatus comprising:

an integrated circuit component comprising one or more integrated circuits;

a cold plate; and a variable conductance heat pipe (VCHP) comprising a first exterior surface and a second exterior surface, the first exterior surface and the second exterior surface being substantially parallel to each other and located opposite from each other, the VCHP directly attached to the cold plate at the first exterior surface, the direct attachment of the VCHP to the cold plate associated with a first area, the VCHP physically coupled to the integrated circuit component at the second exterior surface, the physical coupling of the VCHP to the integrated circuit component associated with a second area that at least partially overlaps the first area.

6. The apparatus of claim 5, wherein the one or more integrated circuits comprise one or more instances of a first integrated circuit and one or more instances of a second integrated circuit, the first integrated circuit different from the second integrated circuit.

7. The apparatus of claim 5, wherein the integrated circuit component comprises a package containing the one or more integrated circuits.

8. The apparatus of claim 5, further comprising a printed circuit board, the integrated circuit component physically coupled to the printed circuit board.

9. The apparatus of claim 5, wherein the first area completely overlaps the second area.

10. The apparatus of claim 5, wherein the VCHP has a length, a width, and a height, the integrated circuit component spaced from the cold plate in a direction of the height of the VCHP, the height of the VCHP being less than the length of the VCHP and less than the width of the VCHP.

11. The apparatus of claim 5, wherein the cold plate comprises a fluid inlet and a fluid outlet, the first area at least partially overlapping a line segment extending from the fluid inlet to the fluid outlet.

12. The apparatus of claim 5, wherein the one or more integrated circuits comprise one or more processing units.

13. The apparatus of claim 5, wherein the integrated circuit component further comprises an integrated heat spreader located adjacent to the VCHP.

14. The apparatus of claim 5, further comprising:

a heat exchanger;

a pump; and one or more conduits to carry a cooling liquid, the one or more conduits arranged to create a loop comprising the heat exchanger and the cold plate.

15. The apparatus of claim 14, further comprising a housing containing the integrated circuit component, the cold plate, the VCHP, the heat exchanger, and the pump.

* * * * *